United States Patent [19]

Eubanks et al.

[11] 4,308,939

[45] Jan. 5, 1982

[54] LUGGAGE CASE WITH BRACE

[75] Inventors: Jerry D. Eubanks, Westminster; Charles F. Rose, Aurora, both of Colo.

[73] Assignee: Samsonite Corporation, Denver, Colo.

[21] Appl. No.: 185,222

[22] Filed: Sep. 8, 1980

Related U.S. Application Data

[62] Division of Ser. No. 44,459, Jun. 1, 1979, Pat. No. 4,239,093.

[51] Int. Cl.[3] ..... A45C 13/34

[52] U.S. Cl. ..... 190/41 R; 217/60 D; 220/335

[58] Field of Search ..... 190/41 R; 217/60 R, 217/60 B, 60 C, 60 D; 220/335

[56] References Cited

U.S. PATENT DOCUMENTS 1,119,892 12/1914 Socin ..... 217/60 D

*Primary Examiner*—Donald F. Norton

*Attorney, Agent, or Firm*—George J. Netter

[57] ABSTRACT

A flat, plate-like member of resilient synthetic plastic has one end pivotally connected to a stud affixed to the inner end wall surface of one luggage shell. One of a pair of elongated, parallel curved slots formed in the plate is received onto a second stud affixed to the other luggage parts such that when the two luggage parts are opened or closed on each other, the stud will slide along and be guided by the slot. The second stud has cross-sectional dimensions larger than the slot width which distends the plastic material between the two slots producing a resilient clamping action on the stud.

5 Claims, 6 Drawing Figures

FIG. 1.
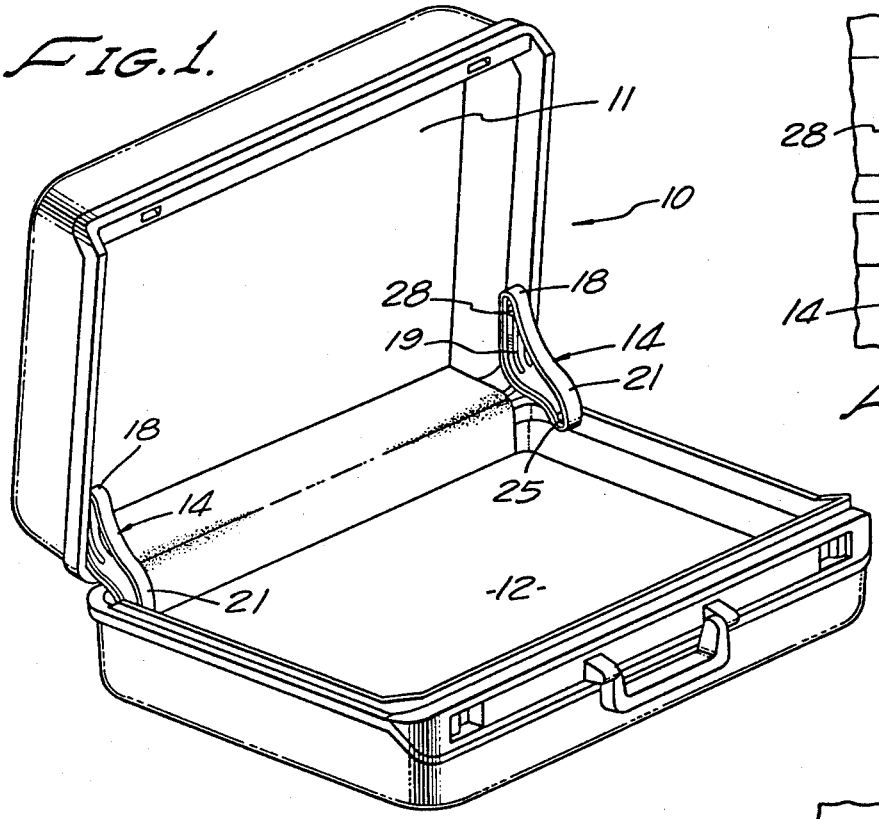
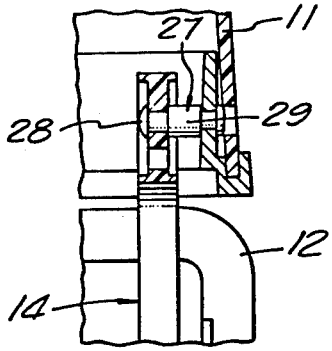
FIG. 4.
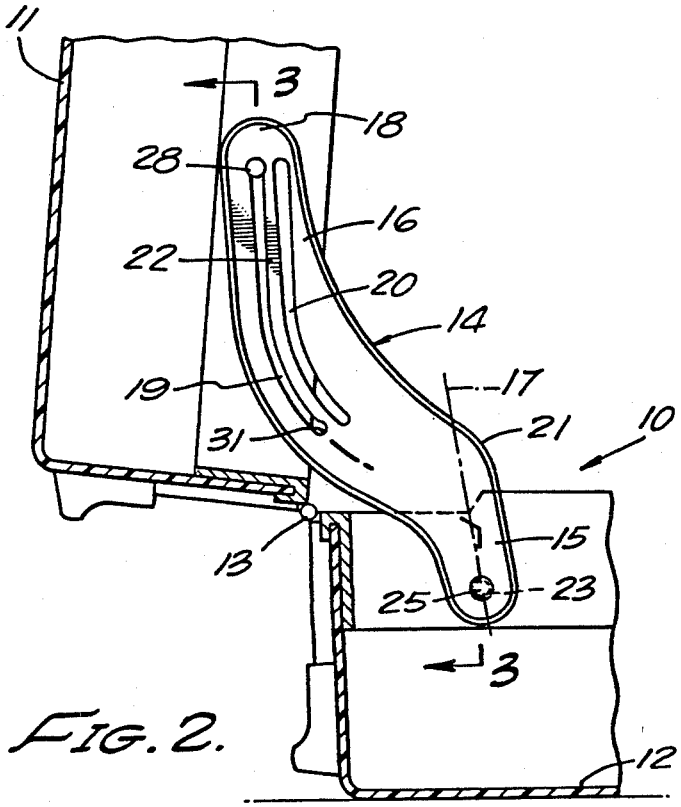
FIG. 2.
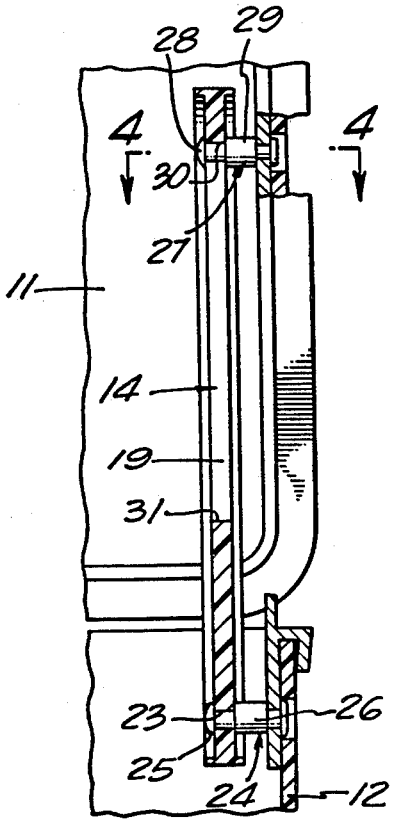
FIG. 3.

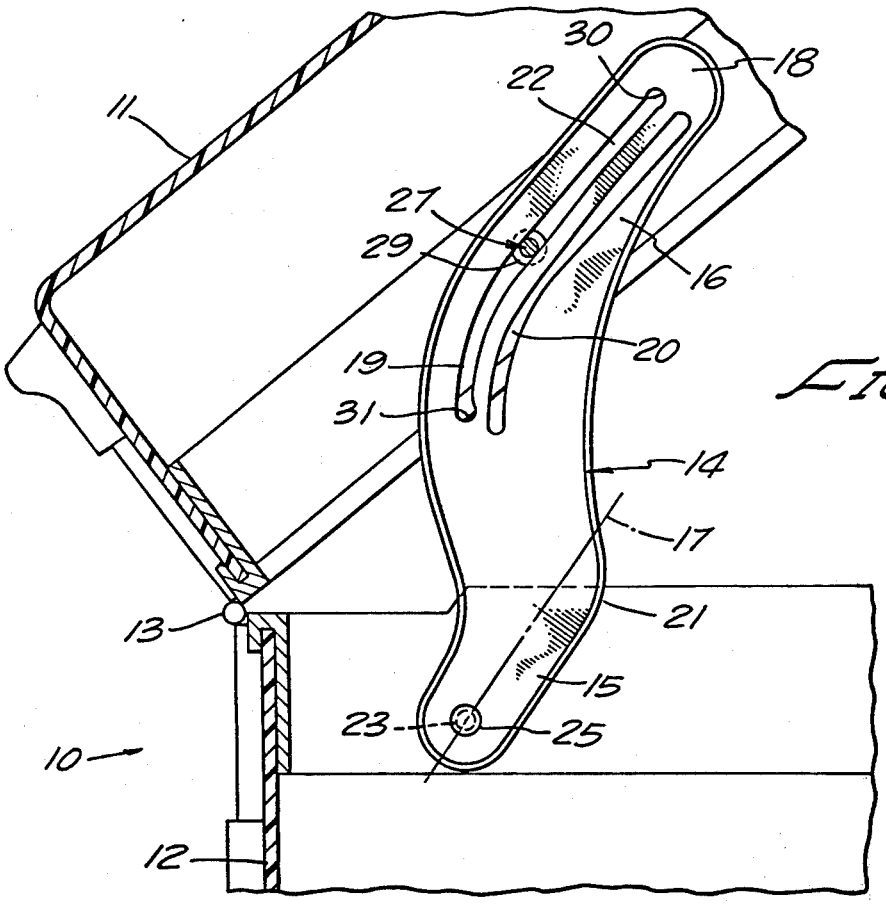
FIG. 5.
FIG. 6.
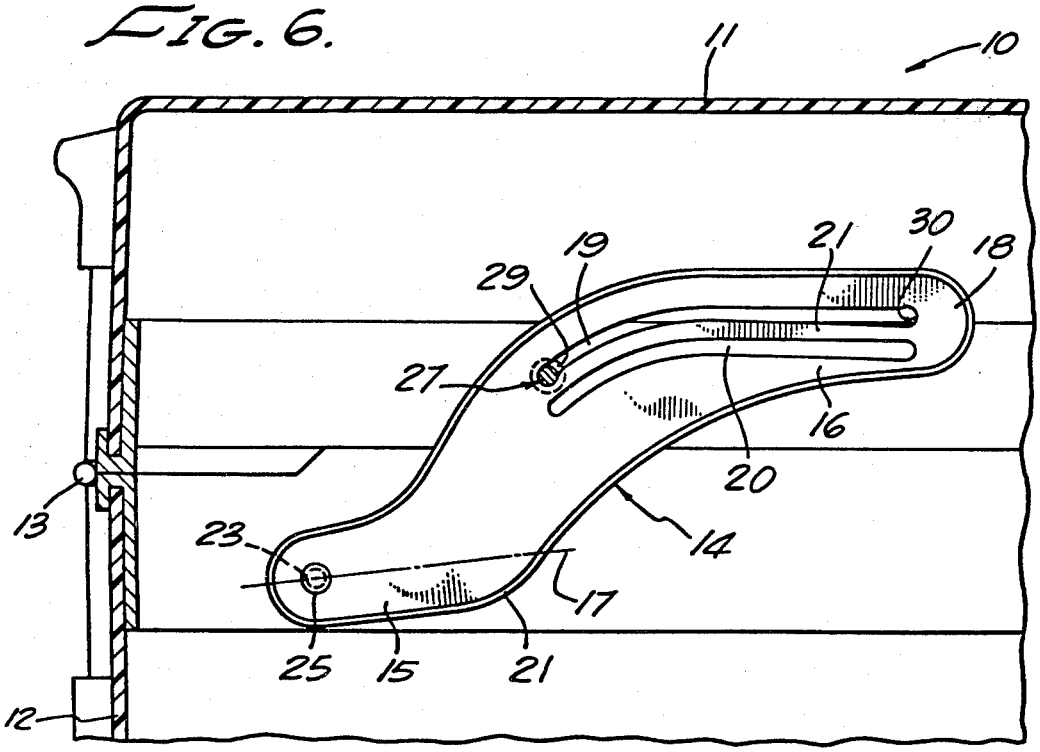

LUGGAGE CASE WITH BRACE

This application is a divisional of United States application Ser. No. 044,459, Luggage Case Brace by Jerry D. Eubanks and Charles F. Rose, filed June 1, 1979, now U.S. Pat. No. 4,239,093.

The present invention relates generally to a carrying case, and more particularly, to an improvement in such a brace or stay for use in a sample case, business luggage case, luggage generally, or other carrying case.

BACKGROUND OF THE INVENTION

It is advantageous in carrying cases, and especially in business luggage cases (i.e., briefcases, attache cases) that some means, such as a brace or a stay, be provided to hold the case parts separated so that the user may place papers therein or take them out without the lid slamming shut. To be fully satisfactory, such a brace or stay should occupy a minimum amount of interior space of the case and should not pose a threat to the hands of the user or damage papers contained in the case during opening and closing. A well-known prior brace consists of a pair of arms pivotally interconnected, the outer ends of which are pivotally joined to the case halves such that when the case is fully open, the arms releasably lock into a straight member preventing inadvertent closing of the case. This known type of brace or stay is not completely satisfactory in that the pinching action between the two arms can tear or otherwise damage papers contained within the case, and it also can inflict injury on the fingers of the user.

SUMMARY OF THE INVENTION

The carrying case may be of conventional construction including a pair of shell-like parts joined together along a common edge by a hinge. The brace to be described is interconnected with both of the case parts end walls adjacent the hinge, and, more particularly, includes a flat, plate-like member of resilient synthetic plastic having one end pivotally connected to a stud affixed to the inner end wall surface of one of the luggage parts. The plate has a pair of elongated, parallel curved slots, one of which is received onto a stud affixed to the other case part such that when the two parts are opened or closed on each other, the stud will slide along and be guided by the slot. The stud or pin received within the slot has cross-sectional dimensions slightly larger than those of the slot which distends the plastic material between the two slots thereby producing a resilient clamping action on the stud. The outermost end of the guide slot is larger than the stud or pin so that when the case is fully open and the stud is located in the large slot end, the slot will close down somewhat below the stud preventing the case from closing by gravity alone.

DESCRIPTION OF THE DRAWINGS

FIG. 1 is a perspective view of a carrying case and brace of the invention shown holding the case parts open.

FIG. 2 is an enlarged elevational, sectional partially fragmentary view of the case and brace of FIG. 1.

FIG. 3 is a sectional, elevational view taken along the line 3—3 of FIG. 2.

FIG. 4 is a sectional view taken along the line 4—4 of FIG. 3.

FIG. 5 is a sectional, elevational view similar to FIG. 2 showing the case partly closed.

FIG. 6 is an elevational view similar to FIGS. 2 and 5 showing the case entirely closed.

DESCRIPTION OF PREFERRED EMBODIMENTS

With reference now to the drawings, and particularly FIG. 1, a typical business paper luggage case, attache case or briefcase, is shown generally as at 10, and is seen to include a pair of luggage case parts or shells 11 and 12 which are related together along a common edge by a hinge 13 permitting the case parts to be closed and opened onto each other. A first version of the brace or stay 14 of the invention is shown interconnected adjacent the hinge 13 to the internal walls of the case end walls, and, in a way that will be described, serves to releasably lock the cases in the open position depicted in FIG. 1, and during closing to provide sufficient resistance to the closing movement to prevent the case parts slamming onto each other possibly injuring the fingers of the user. Moreover, the construction of the stay or brace 14 is such that it will not tend to pinch or tear papers contained within the case, and, in addition, the brace only takes up a minimum amount of space from the interior of the case when the case parts 11 and 12 are fully closed on each other.

Turning now to FIG. 2, the brace or stay 14 is seen to include an elongated, one-piece plate-like member having a first generally straightline portion 15 and a second curved portion 16 integral therewith. The straightline portin 15 extends along an axis 17 that is spaced outwardly of the curved portion 16 thereby locating the end 18 eccentrically with respect to 15.

The curved portion 16 of the brace 14 includes a pair of parallel, elongated slots 19 and 20, each having a relatively straightline portion extending from end points immediately adjacent the brace end 18 for length of approximately one-third the entire length of the brace 14. The centerlines of the slot straightline portions approach the axis 17 at a small angle. The straightline portions of the slots continue as parallel curved portions which turn toward the brace straightline portion 15, the curved length of which are slightly less than that of the slot straightline portions.

The brace 14 is preferably molded from a resilient synthetic plastic into a generally flat, platelike member having its outer peripheral edge defined by a thickened flange. The spacing of the slot 19 and 20 from one another is such as to form a strip 22 of plastic lying therebetween which can readily flex in the general plane of the brace.

The brace straightline portion 15 includes an opening 23 which is rotatably received onto a stud 24 affixed to the inner end wall of the case part 12 and extends into the case interior generally parallel to the axis of hinge 13. The stud has a large head 25 and shoulder 26 to maintain the brace at a constant spacing from the case part end wall.

A further stud 27 is secured to the inner end wall of the case part 11 adjacent to the hinge and extends generally parallel to the hinge. The stud 27 passes through the slot 19 and includes an oversize head 28 preventing removal of the brace from the stud, and an enlarged shoulder 29 for maintaining a fixed spaced relation of the brace from the case end wall.

The part of the stud 27 which is received within the slot 9 has a circular cross-section slightly greater than the slot width which flexes the strip 22 between the two slots and thereby produces a resilient clamping force on the stud due to the inherent resiliency of the material composing the strip. This clamping force on the stud resists closing movement of case shells onto each other so that they cannot be inadvertently slammed onto each other and thereby possibly injuring the user's fingers.

Also, as can be seen best in FIG. 5, the ends of the slot 19 are larger as at 30 and 31 than the width of the remainder of the slot and in that way providing two positions where the stud can be located without distending the strip 22. When the case is fully opened and stud 27 is positioned in the enlarged slot end 30, the case is releasably locked against inadvertent closing by the slot walls having moved to a width underneath the stud less than the stud cross-section. The close case part 11 on 12, sufficient force will have to be applied to case part 11 to force the stud into the slot separating strip 22 from the opposite wall of slot 19.

In the practice of the present invention, there is provided a luggage brace for limiting the open condition of the luggage shells to a prescribed maximum, and for controlling the rate of closure of the shells on each other, so as to reduce the possibility of pinching the fingers of the user. Also, through an eccentric construction of the brace and the special shape of the slot within which a mounting stud is slidingly received, the brace is prevented from moving into that case part that would normally be the lower one and in which papers, documents and the like are carried during opening and closing of the case.

Although the invention herein has been described particularly in relation to its use in a business paper case or so-called attache case, it is contemplated that it would be equally advantageous in other types of carrying cases, such as sample cases or conventional luggage. That is, wherever carrying case parts are desired to be related to one another in a manner that would prevent their being opened beyond a certain predetermined maximum and closing would be at a sufficiently slow rate as to prevent inadvertent injury to the user, the described brace in both of its versions, could be advantageously employed and its use in that manner would be considered within the spirit of the invention.

We claim:

1. Apparatus for controlling the rate and extent of opening and closing a case having first and second case shell parts hinged together, comprising:

a resilient member having a pair of generally parallel elongated slots and a further opening;

a first stud affixed to an inner surface of said first case shell part extending generally parallel to the hinge, which stud is rotatably received within said member further opening; and a second stud received through one of the slots and affixed to an inner wall of said second case shell part, said second stud extending generally parallel to said first stud and having a cross-section dimension exceeding the slot width through which said stud is received.

2. Apparatus as in claim 1, in which the member has a straightline portion integrally related with a curved portion, the member further opening being located in the straightline portion and the slots being located in the curved portion.

3. Apparatus as in either of claims 1 or 2, in which the resilient member is constructed of a molded synthetic plastic.

4. Apparatus as in either of claims 1 or 2, in which the resilient member is constructed of a molded synthetic plastic in platelike form with a thickened flange defining the periphery.

5. Apparatus as in either of claims 1 or 2, in which the slot carrying the second stud includes end portions of dimensions greater than the cross-section of said second stud.

* * * * *